United States Patent [19]

Maurel

[11] Patent Number: 4,662,682

[45] Date of Patent: May 5, 1987

[54] SEAT BACK HEIGHT ADJUSTMENT MECHANISM

[76] Inventor: Jacques A. Maurel, 82, Bd Bineau, 92200 Neuilly, France

[21] Appl. No.: 787,788

[22] Filed: Oct. 15, 1985

[51] Int. Cl.[4] ..... A47C 7/46

[52] U.S. Cl. ..... 297/353

[58] Field of Search ..... 297/353, 410; 248/423; 292/170

[56] References Cited

U.S. PATENT DOCUMENTS

| | | | |
|---|---|---|---|
| 278,323 | 5/1883 | Elliott | 292/170 |
| 478,556 | 7/1892 | Bettmann, Jr. | 292/170 |
| 620,468 | 2/1899 | Lowery et al. | 292/170 |
| 655,543 | 8/1900 | Bohten | 292/170 |
| 2,726,889 | 12/1955 | Lawson | 292/170 |
| 2,988,398 | 6/1961 | Hamilton | 297/353 X |
| 4,043,592 | 8/1977 | Fries | 297/353 X |

*Primary Examiner*—Kenneth J. Dorner

*Assistant Examiner*—Peter R. Brown

*Attorney, Agent, or Firm*—Fuller, Puerner & Hohenfeldt

[57] ABSTRACT

A secretarial chair has a backrest with improved vertical adjustment capabilities. The backrest includes a vertical back brace having aligned vertical notches. A tubular slide slides over the back brace. The slide supports a housing contains a vertically reciprocable latch that actuates a horizontally reciprocable plunger. The plunger has a finger end adapted to enter the back brace notches. Depressing the latch against a spring actuates the plunger to disengage it from the back brace notches, and the backrest can then be positioned to any desired location on the back brace. With the backrest at the desired location, the latch is released, and the spring biases the latch to an extended position and simultaneously actuates the plunger to engage the appropriate back brace notches. The latch can be depressed and the backrest adjusted by a person sitting in the chair, thereby eliminating trial and error adjustments.

2 Claims, 5 Drawing Figures

SEAT BACK HEIGHT ADJUSTMENT MECHANISM

BACKGROUND OF THE INVENTION

1. Field of the Invention.

The present invention pertains to furniture, and more particularly to chairs having vertically adjustable backrests.

2. Description of the Prior Art.

It is well known that office furniture designed to human engineering standards increases worker efficiency and productivity. Properly designed chairs are especially important, because office workers spend considerable portions of the work day seated at their work stations. Chairs that reduce or eliminate fatigue and backache are therefore critical to the modern office.

Various types of specialty office seating has been designed to enhance worker comfort and effectiveness. One common specialty chair is the secretarial chair, which is especially useful for typists and computer operators. Secretarial chairs have distinct and separate backrests and seat portions. The seat height is usually adjustable with respect to the floor, and the forward and backward distance of the backrest relative to the seat portion is also usually adjustable. The backrest normally is tiltable about a transverse horizontal axis.

A major handicap of prior secretarial chairs is the lack of easy vertical adjustment of the backrest relative to the seat. Backrest height adjustment is very important for proper support of the person's back, which is essential for comfort and productivity. It is highly desirable that backrest adjustment be accomplished with the person seated in the chair, so as to eliminate repetitive and wasteful trial and error adjustments. Ease of vertical adjustment makes it practical for different workers to use the same chair, and also to allow a new chair to be quickly put into use.

SUMMARY OF THE INVENTION

In accordance with the present invention, an office chair is provided that has a backrest which is more quickly and easily adjustable vertically than was previously possible. This is accomplished by apparatus that includes a fingered plunger actuated by a readily accessible latch to engage selected vertical notches in the chair back brace.

The fingered plunger and latch are guided within a housing that is supported by a slide that closely fits around the back brace. Vertical movement of the slide on the back brace is prevented when the plunger fingers are in engagement with the back brace notches. A spring biases the latch and, through an angled slot and pin arrangement, the plunger to urge the plunger into engagement with the back brace notches. The housing also supports the backrest shell and upholstery, which enclose the slide, latch, and plunger.

To enhance ease of vertical adjustment of the backrest, the latch is formed with a knobbed end that extends conveniently below the envelope of the backrest shell and upholstery. A worker sitting in the chair is easily able to reach behind her and with her finger depress the latch toward the interior of the backrest. Such pushing action overcomes the bias of the spring, and the latch motion causes the plunger to be withdrawn from the back brace notches. The backrest is then easily slid vertically on the back brace to the desired height while the person is still seated in the chair. When the backrest is in the desired location, the person merely removes her finger from the latch. The spring then returns the latch to the extended inoperative position, and the plunger is urged through the angled slot and pin arrangement to enter the proper notches in the back brace to retain the backrest at the desired location.

To further increase worker comfort, the backrest shell and upholstery portions are tiltable about a transverse horizontal axis. For that purpose, each side of the slide is formed with a short outwardly extending horizontal hub. Mounted to the housing for rotation on each hub are corresponding journals. Thus, the backrest upholstery portion is tiltable to suit the worker's back at all vertical locations of the backrest on the chair.

Other objects, advantages, and features of the invention will become apparent from the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
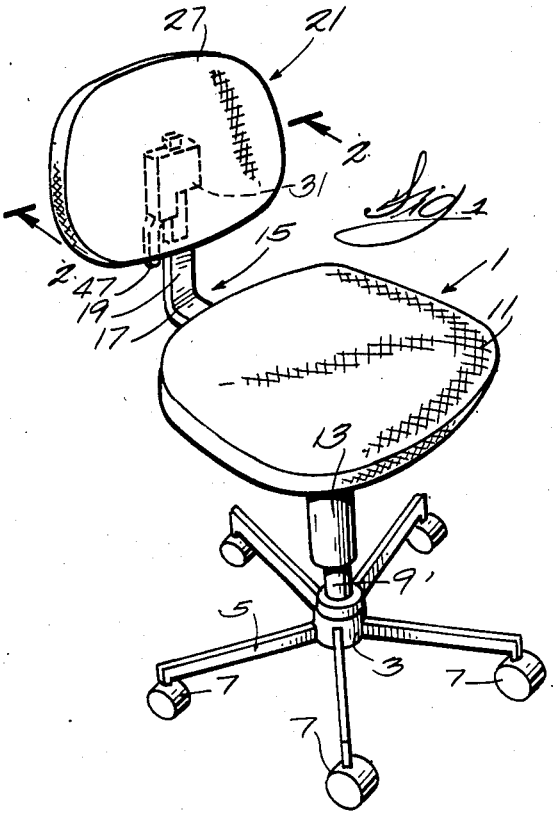
FIG. 1 is a perspective view of an office chair that embodies the present invention.
Figure 5:
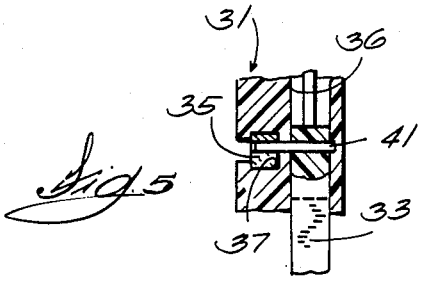
FIG. 5 is a sectional view taken along lines 5—5 of FIG. 4.
Figure 4:
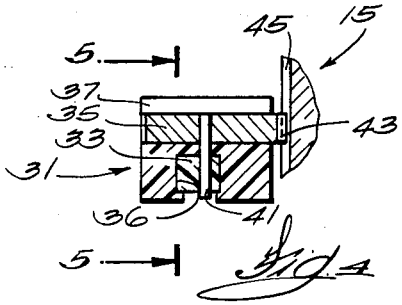
FIG. 4 is a sectional view taken along lines 4—4 of FIG. 2.

Referring to FIG. 1, a chair 1 is shown that includes the present invention. The chair is particularly useful to secretaries and computer operators, and it is understood that the invention is not limited to office applications.

The chair 1 includes a base 3, from which extend several generally horizontal legs 5, each of which may be provided with a conventional caster 7. Mounted to the base 3 is a vertical post 9, which supports a seat portion 11. The seat portion 11 may be vertically adjustable on the post 9 by a mechanism generally indicated at 13, as is known in the art and not shown herein.

To the underside of the seat portion 11 is mounted an angled back brace 15. The back brace 15 is formed with a horizontal section 17 and a generally vertical section 19. The back brace preferably has a generally rectangular cross section. The back brace supports a backrest 21 through a vertically adjustable slide 23 that will be described in detail hereinafter. The slide is manufactured as a rectangular tube that is snugly slideable over the back brace 15.

Figure 2:
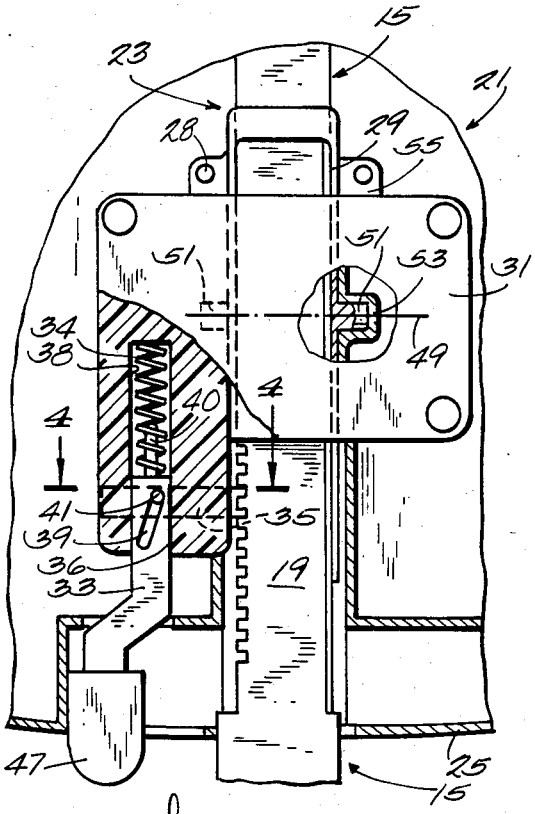
FIG. 2 is an enlarged partial sectional view taken generally along lines 2—2 of FIG. 1 and showing the backrest in engagement with the chair back brace.
Figure 3:
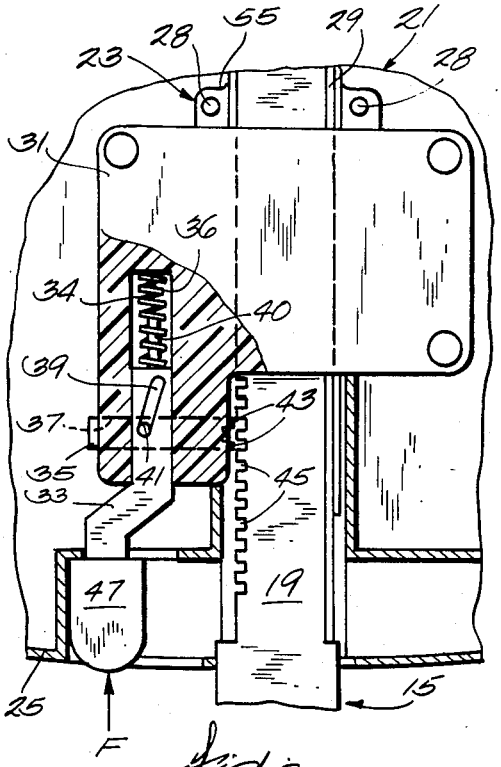
FIG. 3 is a view generally similar to FIG. 2, but showing the backrest in disengagement with respect to the chair back brace.

Referring to FIGS. 2 and 3, the backrest 21 includes a shell 25 that may be made of sheet metal or similar strong but light material. Secured to the shell 25 by any suitable means, not illustrated, is conventional and attractive upholstery as is depicted generally at 27, FIG. 1. To support the shell on the slide 23, the side walls 29 of the slide are fabricated with a pair of oppositely extending short horizontal hubs 51. Mounted over the hubs 51 are a corresponding pair of journals 53 that may be integrally formed with a housing 31. The housing 31 is attached to the shell by conventional fasteners 28 through housing flanges 55.

In accordance with the present invention, the backrest 21 is easily adjustable vertically on the back brace 15 by a person sitting in the chair. For that purpose, a latch 33 is vertically reciprocable within a channel 36 in the housing 31 under the influence of a spring 34 and an opposite external force F that is provided by the person's finger, FIG. 3. The spring 34 is received within a chamber 38 in the housing, and it may be guided on the latch by a rod 40. In FIG. 2, the force F is removed, and the spring biases the latch 33 downwardly to an extended position. To provide a connection between the latch and the back brace 15, a plunger 35 is accurately guided for horizontal reciprocation within a channel 37 in the housing. The plunger 35 is reciprocable under the influence of an angled slot 39 in the latch and a pin 41 secured to the plunger and extending therefrom and received and guided by the slot. The slot is oriented such that when the latch is in the extended position of FIG. 2, the slot forces the pin and thus the plunger to the right with respect to FIG. 2. Referring to FIG. 3, it will be noticed that one end of the plunger is formed with a pair of fingers 43 that are sized to fit within corresponding notches 45 formed in the back brace 15. To provide maximum strength and safety to the adjustment mechanism of the present invention, the fingers 43 and notches 45 are formed as rectangles or squares. With no external force F on the latch, FIG. 2, the spring biases the latch downwardly, and the plunger is urged by means of the slot and pin arrangement to engage the notches 45 of the back brace and retain the backrest in the desired location.

To adjust the vertical position of the backrest 21, a person sitting in the chair 1 merely depresses the latch 33 with the force F, FIG. 3. The lower end of the latch is preferably fabricated with a comfortable knob or sleeve 47. Depressing the latch inwardly toward the interior of the backrest, which is upward in FIGS. 2 and 3, removes or covers the plunger fingers 43 from the back brace notches 45 through the action of the cam slot 39 and pin 41. With the latch thus depressed, the person may easily slide the backrest along the back brace to the desired position. When at the desired position, the force F is removed by the person removing her finger from the knob 47. The spring then returns the latch 33 to the downward extended position of FIG. 2. In turn, the plunger is urged to engage the appropriate notches in the back brace. The latch vertical travel is positively limited by the length of the slot 39.

As previously described, the shell 25 is supported on the slide 29 by means of cooperating hubs 51 on the slide walls 29 and journals 53 on the housing 31. The journals are rotatable with respect to the hubs. Consequently, the backrest 21 is tiltable about a transverse horizontal axis 49 at all locations of the backrest on the back brace 15, which further enhances the comfort of the person using the chair 1.

Thus, it is apparent, that there has been provided in accordance with the invention a seat back height adjustment mechanism that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. In a chair having a base, and seat means supported on the base for supporting a person seated in the chair, an improved backrest comprising:

a. a back brace mounted to the seat means and having a generally vertical section having a plurality of generally vertically spaced notches;

b. a tubular slide slidable over the back brace for vertical reciprocation thereon, the slide including a housing that defines generally rectangular horizontal and vertical non-intersecting channels;

c. a generally rectangular plunger received within the housing horizontal channel for selected reciprocation therein for engagement and disengagement with the back brace notches;

d. a pin attached to one side of the plunger and extending therefrom into the housing vertical channel;

e. a generally rectangular latch received within the housing vertical channel for vertical reciprocation between extended and depressed positions relative to the slide, the latch defining an angled slot for receiving the plunger pin to thereby produce positive horizontal reciprocation of the plunger between the notch engagement and disengagement positions upon vertical reciprocation of the latch;

f. a spring interposed between the housing and the latch to bias the latch and plunger into engagement with the back brace notches; and g. shell means mounted to the housing for providing a backrest, and said plunger means and slide arranged so that when the plunger means is engaged with the back brace notches the slide means is retained against movement relative to the back brace.

2. The improved backrest of claim 1 wherein the slide is formed with a pair of integral and oppositely extending hubs having horizontal axes, and wherein the housing is formed with a pair of integral journals rotationally mounted on the slide hubs, so that the backrest shell means is free to tilt about a horizontal axis for all locations of the backrest on the back brace.

* * * * *